United States Patent [19]

Mohn

[11] Patent Number: 4,731,147

[45] Date of Patent: Mar. 15, 1988

[54] MACHINE FOR LABELING CONTAINERS AROUND THEIR COMPLETE CIRCUMFERENCE

[75] Inventor: Hans W. Mohn, Kaarst, Fed. Rep. of Germany

[73] Assignee: Krones Aktiengesellschaft Hermann Kronseder Maschinenfabrik, Neutraubling, Fed. Rep. of Germany

[21] Appl. No.: 858,403

[22] Filed: May 1, 1986

[30] Foreign Application Priority Data

May 2, 1985 [DE] Fed. Rep. of Germany ..... 3515684

[51] Int. Cl.[4] ..... B65C 9/04

[52] U.S. Cl. ..... 156/456; 74/568 FS; 156/458; 156/567; 156/DIG. 26

[58] Field of Search ..... 156/446, 447, 448, 451, 156/458, 567, 568, 578, DIG. 26, DIG. 27, DIG. 29, DIG. 32, 456; 74/568 FS

[56] References Cited

U.S. PATENT DOCUMENTS

| | | | |
|---|---|---|---|
| 2,589,852 | 3/1952 | Overacker | 74/568 FS |
| 2,945,397 | 7/1960 | Caler et al. | 74/568 FS |
| 3,680,406 | 8/1972 | Bush | 74/568 FS |
| 3,706,438 | 12/1972 | Condon et al. | 74/568 FS |
| 3,960,327 | 6/1976 | Olson | 74/568 FS |
| 3,978,741 | 9/1976 | Bettiol | 74/568 FS |
| 4,430,141 | 2/1984 | Zodrow | 156/458 |

FOREIGN PATENT DOCUMENTS

| | | |
|---|---|---|
| 681511 | 9/1939 | Fed. Rep. of Germany . |
| 2623818 | 12/1977 | Fed. Rep. of Germany . |
| 3024164 | 1/1982 | Fed. Rep. of Germany . |
| 3127309 | 1/1983 | Fed. Rep. of Germany . |
| 3307662 | 9/1984 | Fed. Rep. of Germany . |

OTHER PUBLICATIONS

Krones, Canmatic brochure (Apr. 1983).

*Primary Examiner*—Michael Wityshyn

*Attorney, Agent, or Firm*—Sprung Horn Kramer & Woods

[57] ABSTRACT

A machine for labeling containers around their complete circumference. The machine has a driven rotating turntable with rotating plates that are positioned around its circumference. The plates accommodate the containers and, as they travel past a labeling station, are rotated at different individual speeds by means of a drive mechanism. The drive mechanism includes roller cams and a recessed cam in order to adapt to the cross-sections of the different containers. In order to provide a machine for labeling containers around their complete circumference in which the specific speed of the rotating plates can be considerably more rapidly and easily adapted to the cross-section of the containers being labeled, one section of the recessed cam consists of cam elements that are positioned at intervals, that are designed to yield, and that are adjustably supported.

11 Claims, 12 Drawing Figures

MACHINE FOR LABELING CONTAINERS AROUND THEIR COMPLETE CIRCUMFERENCE

BACKGROUND OF THE INVENTION

The present invention relates to a machine for labeling containers around their complete circumference and having a driven rotating turntable with rotating plates that are positioned around its circumference, that accommodate the containers, and that, as they travel past a labeling station, are rotated at different individual speeds by means of a drive mechanism that includes roller cams and a recessed cam in order to adapt to the cross-sections of the different containers.

A labeling machine of this type is known from German OS No. 3 307 662. The speed of each rotating plate is adapted to the cross-sections of the containers in this machine by means of two mutually displaced toothed cams of a special design that operate in conjunction with star rollers that are fixed to the rotating plates. The toothed cams are designed to rotate the plates at different speeds within subsequent arcs to their path of rotation every time they rotate along with the turntable. The labeling station can be moved along the arcs of different speed. Cammed paths of this type are very expensive to manufacture, and displacing the labeling station along the comparatively long path demands a lot of space that is not readily available with labeling machines, as well as complicating the operation.

Labeling machines in which the speed of the rotating plates can be adapted to different container cross-sections by means of a toothed belt that operates in conjunction with several cogwheels of different diameter are also known (Krones-Canmatic brochure). This means of adaptation, however, demands an open design for the rotating-plate drive mechanism, and it is difficult and time-consuming to mount the belt.

German OS No. 3 127 309 discloses a labeling machine in which each rotating plate is fixed to a planet wheel that engages a sun wheel mounted concentric to the turntable. The sun wheel rotates and is synchronized with the turntable by a transmission with an adjustable rocker and an interchangeable wheel. The speed of the rotating plates can be adapted to various container cross-sections by changing the wheel to obtain a particular transmission ratio between the turntable and the sun wheel. A special wheel must of course be manufactured and kept on hand for each cross-section. Furthermore, the rocker must be readjusted every time the wheel is replaced, making this system of speed adaptation time consuming and attention demanding.

Finally, German OS No. 2 623 818 discloses a labeling machine with a lifting cam with an up-and-down motion that is converted into a plate rotation through a sloping-thread transmission. The lifting cam consists of several components that can be interchanged individually. Not only must a specific component be manufactured and kept on hand for each container cross-section, but, when new cam components are employed, the roller cams that operate in conjunction with the recessed cam for the mechanism that drives the rotating plate have to be threaded in, and the operator may not understand the process correctly, which can lead to severe breakdown.

SUMMARY OF THE INVENTION

The object of the present invention is to provide a machine for labeling containers around their complete circumference in which the specific speed of the rotating plates can be considerably more rapidly and easily adapted to the cross-section of the containers being labeled.

This object is attained in accordance with the invention in that one section of the recessed cam consists of cam elements that are positioned at intervals, that are designed to yield, and that are supported by adjustable means. The means in accordance with the invention result in a labeling machine wherein the speed at which the plates rotate can be adapted to the cross-section of different containers in a conceptually simple way. One advantage is that the elements that constitute the cam path in the section of the recessed cam where the speed is adapted always remain in the labeling machine and do not have to be dismounted during readjustment. It is only the means of supporting the cam elements that must be interchangeable in order to advance the yielding cam elements into the correct position in each case. This makes it possible for example to very simply adjust the cam continuously in the vicinity of the labeling station.

The cam elements in one practical embodiment of the invention consist of at least one strip of spring steel. It turns out to be especially practical for the strips of spring steel to be packaged leaf springs. The mutually facing inner surfaces of the leaf springs can be supported by spacers and the mutually remote outer surfaces by supporting elements.

It turns out to be practical for the supporting elements to have an essentially U-shaped cross-section. It also turns out to be practical for the supporting elements to consist of spacing rollers distributed along the cam path and having a diameter that equals the distance between the leaf springs. The spacing rollers 18 can be retained between the leaf springs to prevent them from being lifted out of the cam path.

It is practical for the supporting elements to consist of supporting pieces that rest on a supporting plate and of vertical journals, each of which is diametrically opposite its associated spacing roller and which engage the outsides of the packages of leaf springs.

For purposes of adaptation to existing rigid cam paths, the leaf springs and vertical journals on the inside of the cam path are of different heights and the leaf spring that positions the roller cams facing the spacing rollers and the leaf spring that positions the roller cams facing away from the spacing rollers consist of a rotating element of the drive mechanism that drives the rotating plates.

To ensure a seamless and reliable transition from the rigid cam path to the yielding section of the cam path, it is practical for the leaf springs at the intake end of the resilient cam path to be secured to lateral retaining strips fastened to the supporting plate and to be capable of moving longitudinally along the outlet end of the resilient cam path.

Also to ensure a seamless and reliable transition, laterally projecting tongues can be provided at the intake and outlet ends of the leaf springs and will preferably be approximately half as high as the roller cams and secured in appropriately shaped recesses in the section of the rigid cam path that merges into the yielding section of the cam path.

For specific sizes of containers to be labeled it is also possible to employ supporting elements that consist of supporting sections associated in pairs. The spacing rollers in this case are secured in position on the supporting plate by permanent magnetism for example and/or by means of a plastic cord or similar structure that extends through the spacing rollers.

For adjusting and locking specific U-shaped supporting elements there is an adjustment-and-locking mechanism. The adjustment-and-locking mechanism can have for example a manually operated threaded spindle.

It is, however, practical for the adjustment-and-locking mechanism to consist of a disk-shaped handle with a threaded pin that operates in conjunction with a tensioning nut extending through it and that has an eccentrically positioned supporting flange and of a centering disk that has its peripheral surface resting in a concave recess and that can be secured to the disk-shaped handle by means of a threaded bolt that can be displaced along a longitudinal slot in the handle. A mechanism of this type, which can be returned to a base setting, makes it possible to adjust the yielding leaf springs very rapidly and easily.

The machine can have a spring-loaded rapid-locking device for securing the supporting sections 48 and 49 that are mounted on and can be adjusted in relation to the supporting plate.

Some preferred embodiments of the invention will now be described with reference to the attached drawings, wherein

DETAILED DESCRIPTION OF THE PREFERRED EMBODIMENTS

Figure 1:
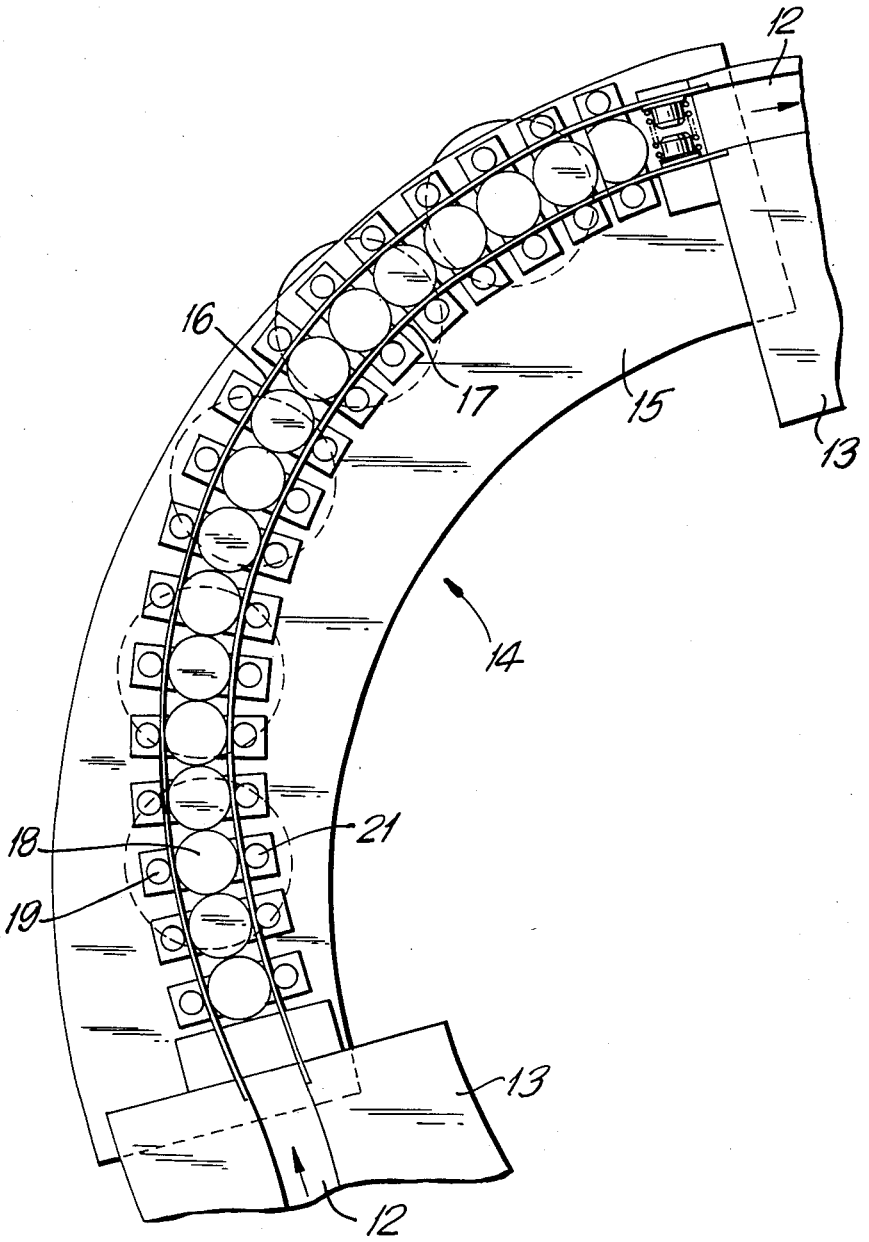
FIG. 1 is a top view of the yielding section of a cam path between two rigid sections of the cam path.

A labeling machine that is not illustrated in detail is intended to equip bottles with full-circumference labels. The bottles are supplied inside the machine to a continuously revolving turntable 1 (FIG. 2) in the form of a spoked wheel with a rim that has a cross-section in the shape of a U that opens inward. Rotating plates 2 that execute their own separate rotation are mounted on the circumference of turntable 1. The bottles are secured between rotating plates 2 and unillustrated centering bells that can be raised and lowered and that are mounted on the likewise unillustrated upper part of turntable 1. The bottles accordingly follow the specific rotation of rotating plates 2 in relation to turntable 1. The bottles also travel with turntable 1 past an unillustrated labeling station where full-circumference labels are applied to them. Each rotating plate 2 is rotated around it own axis of rotation by means of a drive mechanism 3 that consists of a cogwheel 5 mounted on a shaft 4, of another cogwheel 6 that meshes with cogwheel 5 and is mounted on another shaft 7, and of a pivoting lever arm 8. Mounted on lever arm 8 is a sensor in the form of a pair of roller cams 9 and 16 that travel in a recessed cam 12 on a cam support 13.

With reference now to FIG. 1, cam support 13 is cut off at a certain section, specifically in the vicinity of the labeling station, and replaced with a specially shaped cam piece 14. Cam piece 14 consists initially of an arcuate supporting plate 15 screwed securedly to cam support 13 and having positioned on it yielding cam elements in the form of strips of spring steel or of packaged leaf springs 16 and 17. Leaf springs 16 and 17 are, as will be specified later herein, secured at both the intake and outlet ends to cam support 13. The distance between leaf springs 16 and 17 is established by spacing rollers 18 extending along the path, and each spring is supported at its outer surface by vertical journals 19 and 21, each of which is directly opposite a spacing roller and is secured in a supporting piece 22 mounted on supporting plate 15. Spacing rollers 18 are secured in supporting pieces 22.

Figure 2:
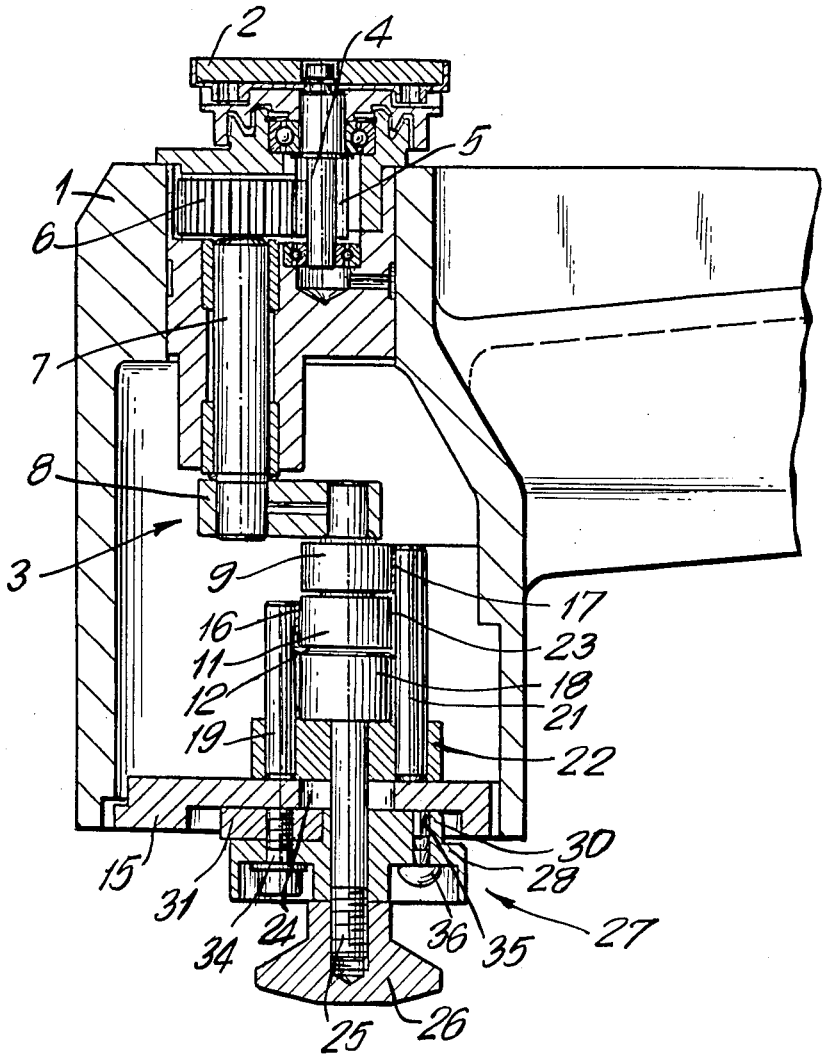
FIG. 2 is a larger-scale partial vertical longitudinal section through a turntable with a rotating element that drives a rotating plate.
Figure 3:
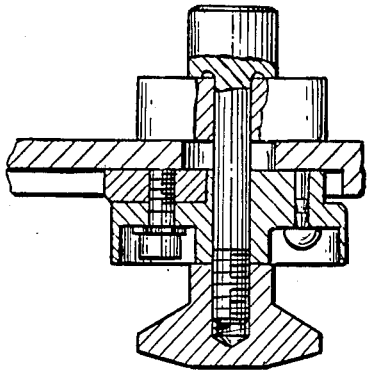
FIG. 3 is a partial longitudinal section through an adjustment-and-locking mechanism.

With reference now to FIG. 2, each roller cam 9 rests against the inside of leaf spring 17 and rolelr cam 11 against the inside of leaf spring 16. Leaf spring 17, which is on the whole higher than leaf spring 16, has a recess 23 at the level of roller cam 11, which prevents roller cam 11 from coming into contact with that section of leaf spring 17. The supporting units, which are distributed along the yielding cam path and which consist on the one hand of spacing rollers 18 and on the other of supporting pieces 22 and vertical journals 19 and 21 are mounted loose, so that, when the cam path is readjusted as will be described later herein, the supporting elements will automatically adjust themselves perpendicular to the tangent of the curve as the curve of the path varies.

Figure 4:
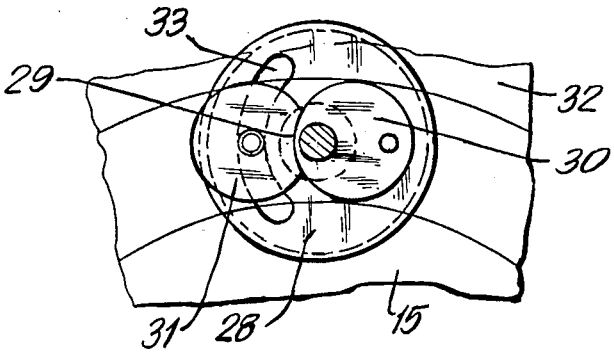
FIG. 4 is a bottom view of the adjustment-and-locking mechanism.
Figure 5:
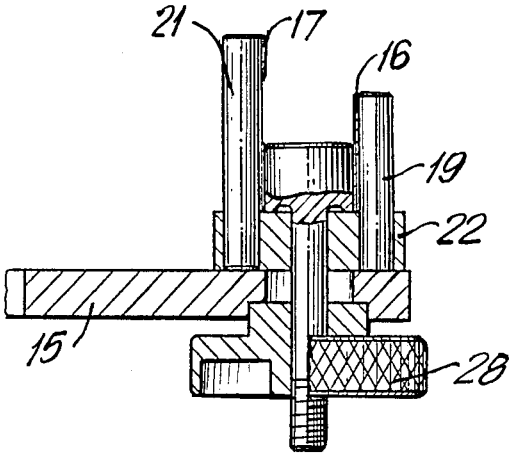
FIG. 5 is a partial transverse section through the adjustment-and-locking mechanism.

Some of spacing rollers 18 have a tension screw 25 that extends through an aperture 24 in supporting plate 15 with a knob 26 that is part of an adjustment-and-locking mechanism 27. This mechanism consists of a disk-shaped handle 28 with a supporting flange 30 that is positioned eccentric to tension screw 25 and a centering disk 31 that is mounted inside it on a concave recess 29 (FIG. 4), both of which can be inserted in arcuate slot 32 on the bottom of supporting plate 15. Centering disk 31, which can be returned to a base position, can be secured to disk-shaped handle 28 by means of a screw 34 that can be adjusted in a longitudinal slot 33. Indicating heads 36 of different colors can be inserted in a bore 35 to indicate the particular base position of the mechanism. The curve of leaf springs 16 and 17 can be varied by apropriately adjusting centering disk 31 in relation to the supporting flange 30 on disk-shaped handle 28 and inserting a previously obtained setting unit on the tensioning screw. Fine adjustment can then be carried out if necessary by loosening screw 34 and rotating centering disk 31 in relation to the supporting flange 30 on disk-shaped handle 28.

Figure 7:
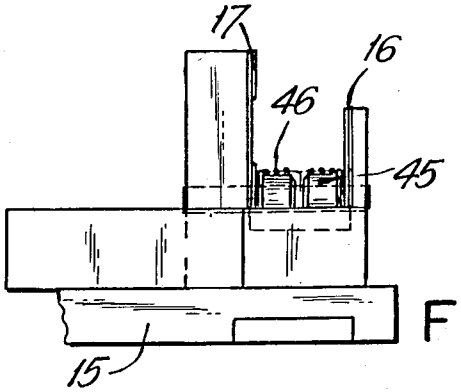
FIG. 7 is a side view of the outlet-end section of the cam path.
Figure 9:
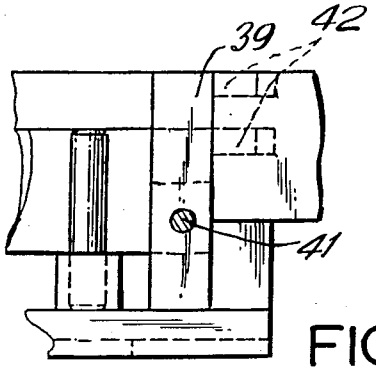
FIG. 9 is a front view of the intake-end section of the cam path.
Figure 6:
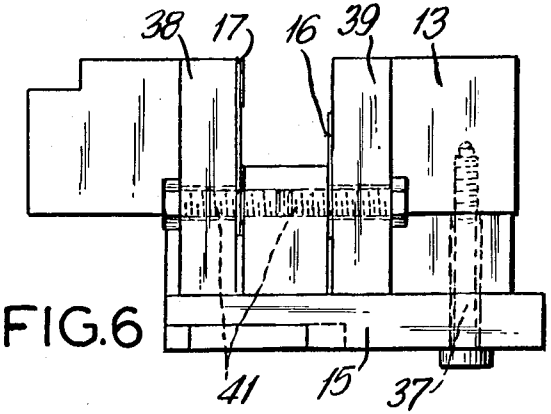
FIG. 6 is a side view of the inlet-end section of the cam path.
Figure 8:
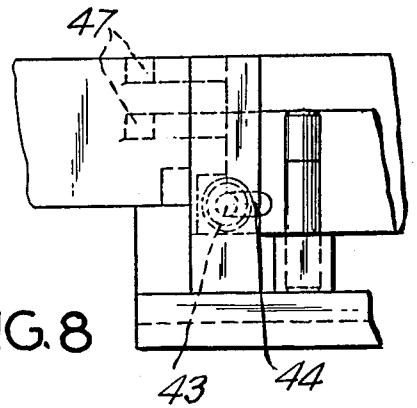
FIG. 8 is a front view of the outlet-end section.

FIGS. 6 and 9 illustrated the intake-end area of leaf springs 16 and 17 and FIGS. 7 and 8 their outlet-end area.

With reference now to FIG. 6, supporting plate 15 is fastened with screws 37 to rigid cam support 13, which itself has lateral retaining strips 38 and 39 to which the intake-end sections of leaf springs 16 and 17 are fastened with screws 41. The intake ends of leaf springs 16 and 17 are provided with tongues 42 that are about half as high as a roller cam and are positioned in appropriately shaped recesses in rigid cam support 13, to establish a smooth transition between the rigid and resilient sections of the cam.

With reference now to FIGS. 7 and 8, there is a longitudinally movable guide at the outlet end of leaf springs 16 and 17 that consists of a pin 43 and a longitudinal slot 44 as well as of bolts 45 that position a compression spring 46 and that are themselves positioned along the inside of leaf springs 16 and 17. Tongues 47 like those at the intake end of the springs are also provided at the outlet ends, to provide a smooth transition between the two sections of the cam path.

Instead of a series of supporting units as illustrated in FIGS. 1 through 5, the leaf springs 16 and 17, which always remain in the machine, can, if conditions are simple enough, be supported along the outside by pairs of associated supporting sections.

Figure 10:
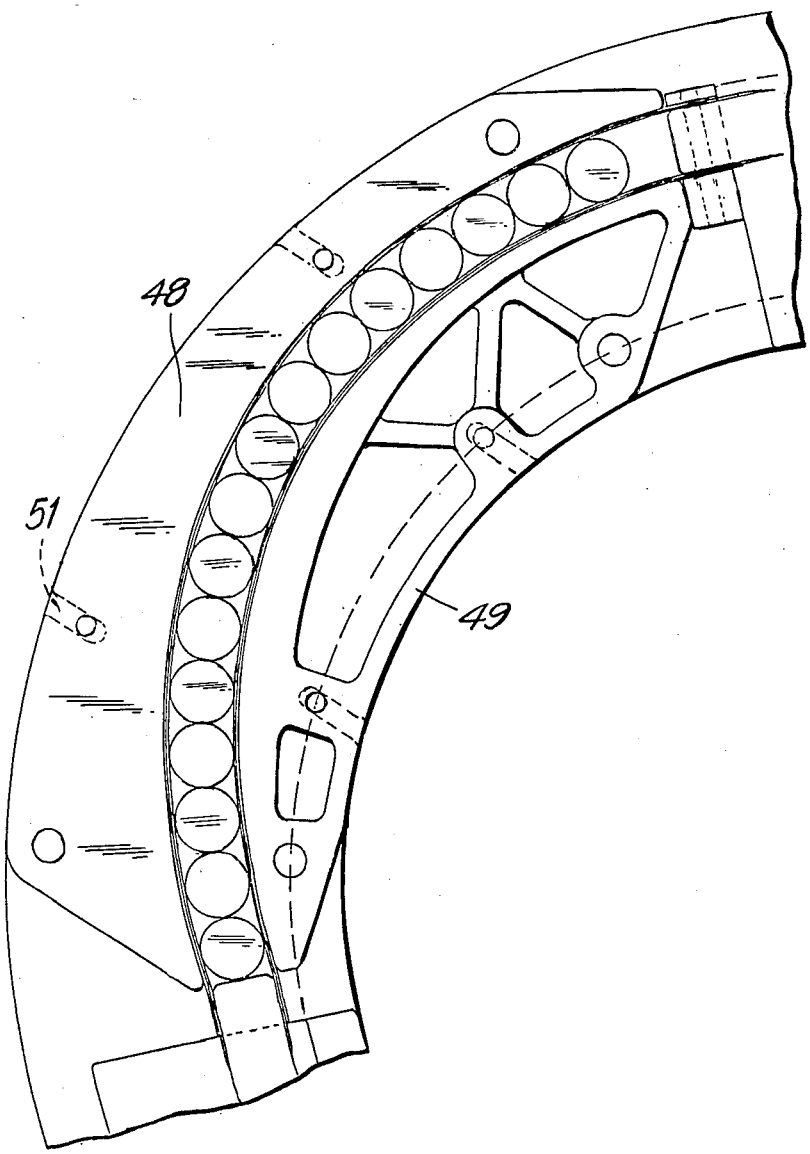
FIG. 10 is a top view of another embodiment of the support for the yielding cam elements.
Figure 11:
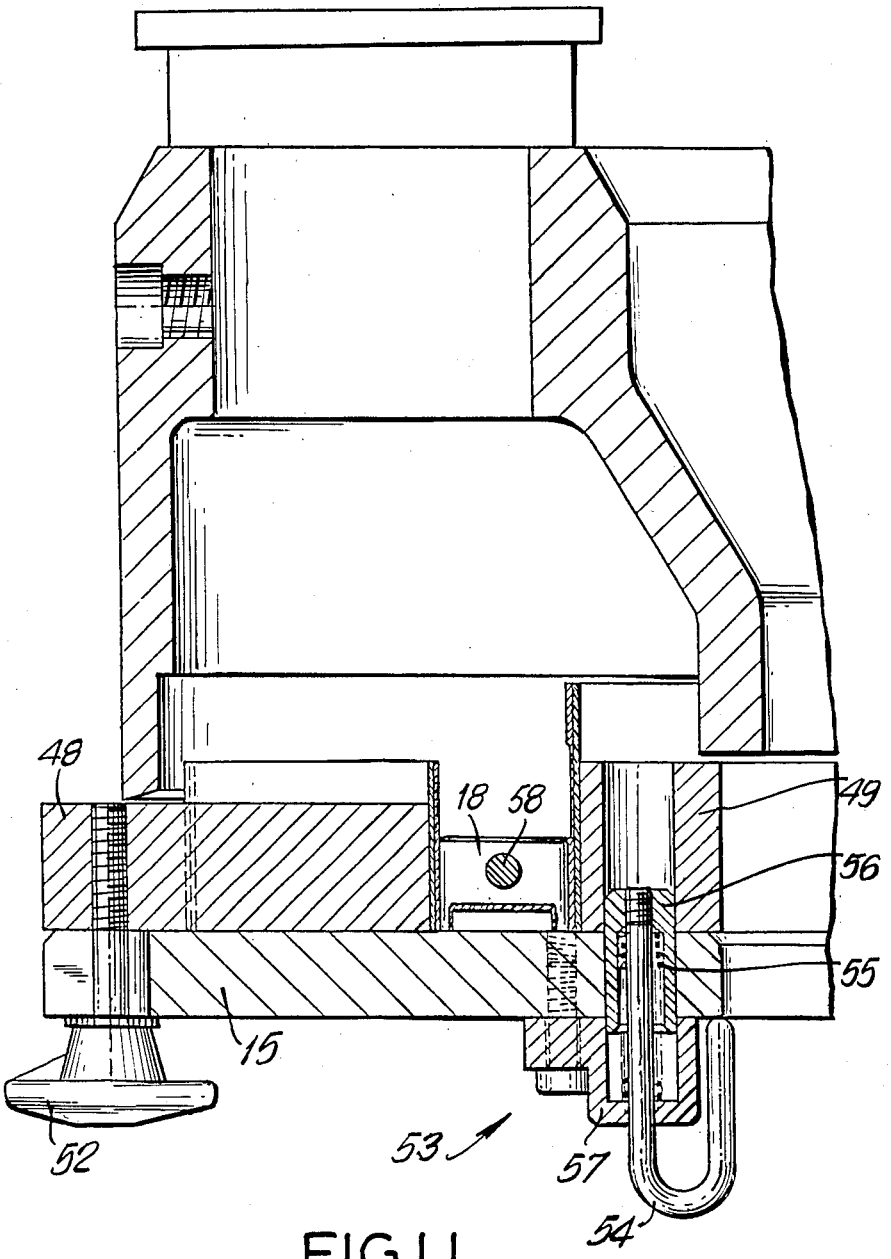
FIG. 11 illustrates a rapid-locking device for securing the supporting elements.

An embodiment of this type is illustrated in FIGS. 10 and 11. Each pair of associated supporting sections 48 and 49 is matched to a particular container cross-section. These supporting elements can be mounted and dismounted relatively easily. For this purpose there are longitudinal slots 51 in supporting plate 15. Tension screws 52 that screw into the supporting sections extend through the slots. Supporting sections 48 and 49 are locked into place with a rapid-locking device 53 as illustrated in FIG. 11. It consists essentially of an activating bracket 54 and of a locking bolt 56 that is subject to a spring 55, one end of which rests on a positioning head 57. Spacing rollers 18, which now rest directly on supporting plate 15, can either again be magnetic or fastened together by a plastic cord 58 that extends through them transversely to ensure that they do not become detached from the cam path.

Figure 12:
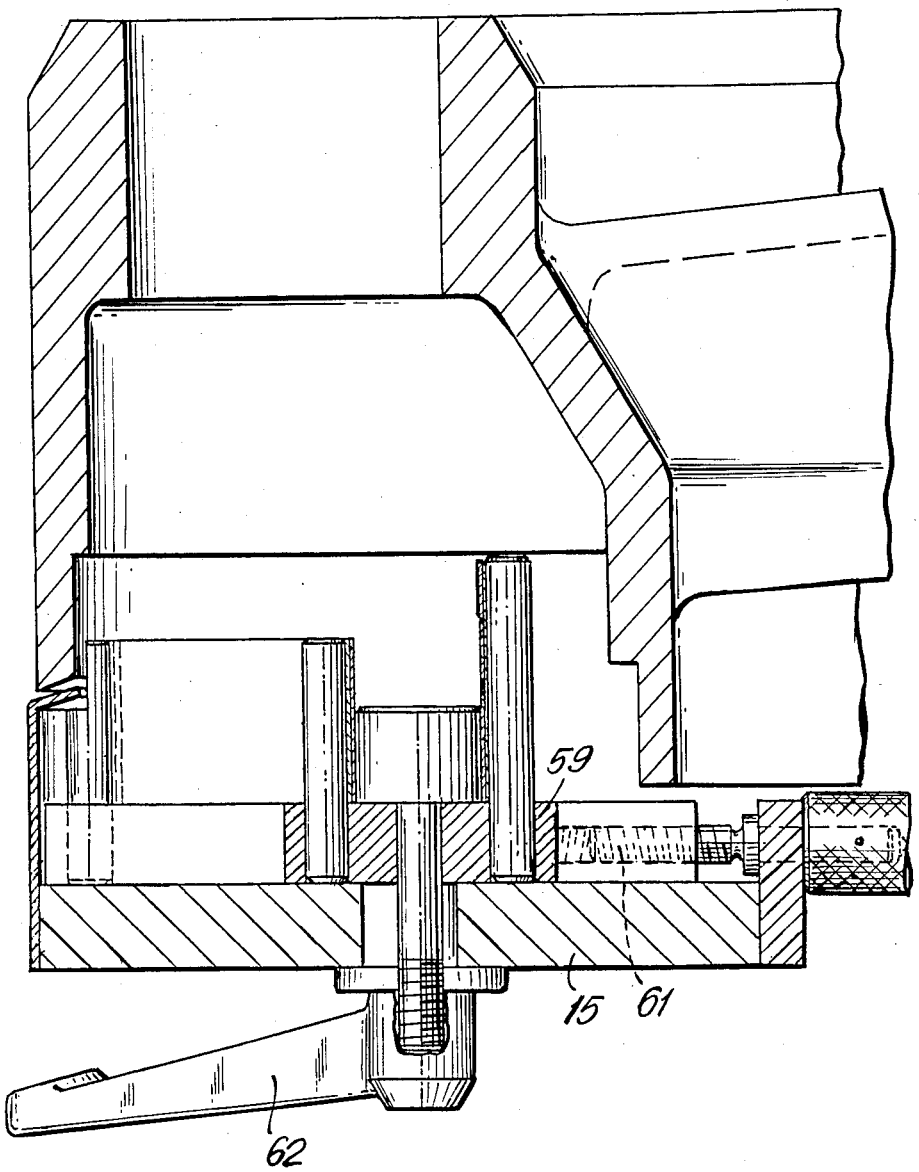
FIG. 12 is a different embodiment of the adjustment-and-locking mechanism.

FIG. 12 illustrates another type of adjustment-and-locking mechanism, which consists essentially of an extended supporting piece 59 and of a threaded spindle 61 inserted into it and resting on supporting plate 15. The supporting unit is locked into place with a manually operated knob 62.

It will be evident that the rigid cam path will still permit only partial labeling in the vicinity of the rear-label labeling station.

Finally, a yielding cam path can be employed wherever time-path variations are desired, in centering-head mechanisms in the hood of a labeling machine for example.

It will be appreciated that the instant specification and claims are set forth by way of illustration and not limitation, and that various modifications and changes may be made without departing from the spirit and scope of the present invention.

What is claimed is:

1. In a machine for labeling containers completely around their circumference, having a driven rotating turntable with rotating plates that are positioned around the circumference of the turntable and accommodate the containers, and drive means for rotating the plates at different individual speeds as the plates travel past a labeling station, including roller cams and a recessed cam defining a cam path for adapting to the cross-sections of different containers, the improvement wherein: one section of the recessed cam comprises yieldable cam elements each comprising spaced apart spring steel leaf springs that are positioned at intervals along the cam path, wherein the leaf springs have mutually facing inner surfaces supported by spacing rollers and mutually remote outer surfaces supported by supporting elements and wherein the spacing rollers have a diameter that equals the distance between the leaf springs and means for retaining the spacing rollers between the leaf springs to prevent the spacing rollers from being lifted out of the cam path, and adjustable means for supporting the cam elements.

2. The machine as in claim 1, wherein the supporting elements have an essentially U-shaped cross-section.

3. The machine as in claim 1, wherein the supporting elements comprise supporting pieces that rest on a supporting plate and vertical journals, each journal being diametrically opposite its associated spacing roller and engaging the outer surfaces of the leaf springs.

4. The machine as in claim 3, wherein the leaf springs include inner and outer leaf springs, wherein the inner and outer leaf springs and vertical journals are at different heights.

5. The machine as in claim 1, wherein the leaf springs at an intake end are secured to lateral retaining strips fastened to the supporting plate and are movable longitudinally along an outlet end to define a resilient cam path.

6. The machine as in claim 5, wherein laterally projecting tongues are disposed at the intake and outlet ends of the leaf springs and are approximately half as high as the roller cams and are secured in appropriately shaped recesses in a section of a rigid cam path that merges into the resilient cam path.

7. The machine as in claim 1, wherein the supporting elements comprise a pair of supporting sections.

8. The machine as in claim 7, further comprising an adjustment-and-locking mechanism for the supporting elements.

9. The machine as in claim 8, wherein the adjustment-and-locking mechanism has a manually operated threaded spindle.

10. The machine as in claim 8, wherein the adjustment-and-locking mechanism further comprises a disk-shaped handle with a screw extending therethrough operable in conjunction with a knob, an eccentrically positioned supporting flange on said handle, and a centering disk having a peripheral surface resting in a concave recess of the disk and secured to the disk-shaped handle by a threaded bolt displaceable along a longitudinal slot in the handle.

11. The machine as in claim 1, further comprising a spring-loaded rapid-locking device for securing the supporting elements mounted on the supporting plate for adjustable movement relative thereto.

* * * * *